US006486395B1

(12) United States Patent
Temblador

(10) Patent No.: US 6,486,395 B1
(45) Date of Patent: Nov. 26, 2002

(54) INTERLOCKED METAL-CLAD CABLE

(75) Inventor: Richard M. Temblador, Fullerton, CA (US)

(73) Assignee: Alflex Corporation, Louisville, KY (US)

( * ) Notice: Subject to any disclaimer, the term of this patent is extended or adjusted under 35 U.S.C. 154(b) by 0 days.

(21) Appl. No.: 09/602,078

(22) Filed: Jun. 22, 2000

(51) Int. Cl.[7] ..... H01B 7/00
(52) U.S. Cl. ..... 174/36; 174/102 R; 174/113 R
(58) Field of Search ..... 174/36, 27, 113 R, 174/109, 102 D, 105 R, 106 R, 102 R, 116

(56) References Cited

U.S. PATENT DOCUMENTS

| | | | | |
|---|---|---|---|---|
| 2,866,843 A | * | 12/1958 | Arman | 174/106 R X |
| 4,374,299 A | * | 2/1983 | Kincaid | 174/36 |
| 5,329,065 A | * | 7/1994 | Marney et al. | 174/113 R X |
| 5,350,885 A | * | 9/1994 | Falciglia et al. | 174/109 X |
| 5,416,268 A | * | 5/1995 | Ellis | 174/102 R X |
| 6,259,019 B1 | * | 7/2001 | Damilo et al. | 174/102 R |
| 6,310,295 B1 | * | 10/2001 | Despard | 174/113 C |

OTHER PUBLICATIONS

Underwriters Laboratories Inc., UL4, Standard for Safety, Armored Cable, Nov. 4, 1998.
Underwriters Laboratories Inc., UL 1569, Metal–Clad Cables, Jan. 25, 2000.
National File Protection Association, NFPA 70 National Electrical Code, 1999 Edition, Article 100, 250, 333, 334, 517.

* cited by examiner

*Primary Examiner*—Chau N. Nguyen
(74) *Attorney, Agent, or Firm*—James C. Eaves, Jr.; Karen L. Lynd; Greenebaum Doll & McDonald PLLC

(57) ABSTRACT

A cable having a conductor assembly containing at least two electrically insulated conductors, where the at least two electrically insulated conductors are cabled together longitudinally into a bundle and enclosed within an overall cover, preferably nonmetallic; a bare bonding/grounding conductor cabled externally over the overall cover of the conductor assembly with the same lay and in concert with the conductors cabled within the conductor assembly; and a metal tape helically applied to form an interlocked armor around the cabled conductor assembly and bare bonding/grounding conductor. The bare bonding/grounding conductor is a similar size to the insulated conductors present in the conductor assembly and is in intimate contact with the inner curves of the convolutions in the interlocked metal tape armor along a substantial length of the cable. The armor and bare bonding/grounding conductor act in concert to provide a metallic sheath assembly which has an ohmic resistance value equal to or lower than the ohmic resistance requirements necessary to qualify as an equipment grounding conductor. In addition, an electrically insulated grounding conductor may be cabled within the conductor assembly to provide a redundant grounding path.

31 Claims, 5 Drawing Sheets

INTERLOCKED METAL-CLAD CABLE

BACKGROUND OF THE INVENTION (a) Field of the Invention

The present invention relates to a Metal-Clad Cable which has an interlocked metal tape armor as part of a metallic sheath assembly which provides a low impedance and a reliable ground path and functions as an equipment grounding conductor. The present invention has a conductor assembly containing at least two electrically insulated conductors, where the at least two electrically insulated conductors are cabled together longitudinally into a bundle and enclosed within an overall cover, preferably nonmetallic. A bare bonding/grounding conductor is cabled externally over the overall cover of the conductor assembly with the same lay and in concert with the conductors cabled within the conductor assembly. Metal tape is helically applied to form an interlocked armor around the cabled conductor assembly and bare bonding/grounding conductor. The bare bonding/grounding conductor is generally a similar size to the insulated conductors present in the conductor assembly; however, as the gauge of the conductors increases, it is acceptable for the size difference between the bare bonding/grounding conductor and the insulated conductors to increase (collectively hereinafter, "preferably full size"). Fillers may then be cabled internally within the conductor assembly to fill in undesirable spaces in the conductor assembly. This sizing, along with the use of fillers where desired, enables the bare bonding/grounding conductor to be in intimate contact with the inner curves of the convolutions in the interlocked metal tape armor along a substantial length of the cable. The armor and bare bonding/grounding conductor act in concert to provide a metallic sheath assembly which has an ohmic resistance value equal to or lower than the ohmic resistance requirements necessary to qualify as an equipment grounding conductor. In addition, an electrically insulated grounding conductor may be cabled within the conductor assembly to provide a redundant grounding path for cable which is to be used in patient care areas of Health Care Facilities, in addition to other applications.

(b) Description of the Prior Art

Underwriter Laboratory Standard for Safety for Armored Cables UL 4 (hereinafter "AC Cable," and hereinafter "UL 4") provides construction guidelines and performance standards for interlocked steel or aluminum armored cables which contain two, three, or four electrically insulated conductors of size No. 14 AWG to 1 AWG. Cables covered by UL 4 are for use as type AC Cable in accordance with Section 333, and other applicable sections, of the National Electrical Code (hereinafter "NEC").

NEC Section 333 provides minimum requirements for type AC Cable, including construction requiring a flexible metal tape armor and an internal bonding strip of copper or aluminum in intimate contact with the armor for its entire length, in accordance with NEC Section 333-19; electrically insulated conductors with an overall moisture-resistant and fire-retardant fibrous covering, in accordance with NEC Section 333-20; and an adequate equipment grounding path, in accordance with NEC Sections 333-21 and 250-2(d).

NEC Section 250-2(d) requires that the fault current path shall be permanent and electrically continuous, capable of safely carrying the maximum fault likely to be imposed upon it, and shall have sufficiently low impedance to facilitate the operation of overcurrent devices under fault conditions.

Underwriter Laboratory Standard for Safety for Metal-Clad Cables UL 1569 (hereinafter "MC Cable" and hereinafter "UL 1569") provides construction guidelines and performance standards for metal-clad cables which may or may not contain optical fiber members and which contain one or more electrically insulated conductors of size No. 18 AWG to 2000 kcmil. Cables may, but are not required to, contain fillers. If fillers are used, they must be cabled or laid straight with the electrically insulated conductors. Cables covered by UL 1569 are for use as type MC Cable in accordance with NEC Section 334, and other applicable sections of the NEC.

NEC Section 334 provides minimum requirements for type MC Cable, including construction requiring (1) an armor of continuous and close fitting interlocking metal tape, or (2) a smooth metallic sheath, or (3) a corrugated metallic sheath, in accordance with NEC Sections 334-1 and 334-22; solid or stranded copper conductors with a minimum conductor size of 18 AWG, or solid or stranded aluminum or copper-clad aluminum conductors with a minimum conductor size of 12 AWG, in accordance with NEC Section 334-20; and, an adequate equipment grounding path, in accordance with NEC Sections 334-23 and Article 250.

UL 1569 Tables 6.1 and 6.2 set forth the smallest acceptable sizes for copper, aluminum or copper-clad aluminum grounding conductors in cable containing 90 degree Celsius and 75 degree Celsius circuit conductors, respectively.

NEC Section 250-96 requires that the cable armor which serves as a grounding conductor must be effectively bonded where necessary to ensure electrical continuity and the capacity to conduct safely any fault current likely to be imposed thereon.

NEC Section 250-118 requires, in applicable part, that the equipment grounding conductor running with or enclosing the circuit conductors be one or more or a combination of the following: (1) a copper or other corrosion-resistant conductor which may be solid or stranded, and electrically insulated, covered, or bare; (9) armor of type AC cable as provided in NEC Section 333-21; or (11) the metallic sheath or the combined metallic sheath and grounding conductors of type MC cable.

NEC Article 517 sets forth the requirements for wiring of Health Care Facilities. NEC Section 517-13(a) and (b) set forth the requirements for wiring of patient care areas. Pursuant to 517-13, the grounding terminals of all receptacles and all noncurrent carrying conductive surfaces of fixed electric equipment likely to become energized that are subject to personal contact, operating at over 100 volts, must be grounded by an electrically insulated copper conductor. If type MC or AC cable is used, the outer metal armor or sheath of the cable must be an acceptable grounding return path and also must qualify as an equipment grounding return path in accordance with NEC Section 250-118.

Metal sheathed cables, such as AC Cable and MC Cable, are available in armor composed of steel or aluminum interlocked metal tape. The edges of the helically wrapped metal tape armor interlock to form a series of "S" shaped convolutions along the length of the cable. MC Cable is also available in sheaths made of smooth or corrugated metal. MC Cable having interlocked metal tape armor and AC Cable are similar in appearance but differ in internal construction, performance, permitted uses, and safety features.

AC Cable contains a conductor assembly composed of two, three, or four electrically insulated conductors which are individually enclosed in fibrous covers. The individually enclosed conductors are cabled into a bundle wherein the conductors are twisted longitudinally together with a left-handed lay in accordance with the lay requirements defined in Section 5.5 of UL 4. The conductor assembly may contain one or more grounding conductors. If a bare grounding conductor is present, it may be individually enclosed in a fibrous cover before being cabled with the other conductors or the cabling assembly must be collectively enclosed in a fibrous cover to prevent the bare conductor from contacting the armor. During the armoring process, a bonding strip is laid lengthwise along the conductor assembly. The bonding strip and the conductor assembly are fed together into an armoring machine, where interlocking metal tape is helically applied around the conductor assembly to form an armor around the cabled conductor assembly and bonding strip. The bonding strip is composed of a strip of a thin bare copper, aluminum, or copper-clad aluminum conductor which runs longitudinally along the cable in direct contact with and electrically parallel to the armor. The bonding strip in parallel with the metal-tape interlocked armor forms a permanent, electrically conductive path that will ensure electrical continuity and the capacity to conduct safely any fault current likely to be imposed thereon. The AC Cable metal sheath assembly, comprised of the metal-tape interlocked armor and the longitudinally applied bonding strip, meets the ohmic resistance requirements for equipment grounding conductors specified in UL 4, Section 15. However, the grounding capability of the metal sheath assembly in AC Cable is significantly less than that of MC Cable of equal conductor size.

MC Cable contains a conductor assembly composed of one or more electrically insulated conductors collectively encased longitudinally in an overall covering. The overall covering may be one of several constructions specifically enumerated in UL 1569 or another construction which complies with the crushing, impact, and flexibility requirements of UL 1569. The conductor assembly may contain one or more grounding conductors, but only one grounding conductor may be bare. Generally, the conductors are cabled together into a bundle by twisting the conductors longitudinally together with a left- or right-handed lay in accordance with the lay requirements defined in Section 9.2 of UL 1569. One or more fillers, composed of a non-conductive, nonmetallic material, may be cabled (or laid straight) with the electrically insulated conductors within the conductor assembly as provided in Section 10.1 of UL 1569. After the conductors are cabled, they are collectively encased longitudinally in an overall covering. The conductor assembly is then fed into an armoring machine, where metal tape is helically applied around the conductor assembly to form an interlocked armor.

The metallic sheath of smooth or corrugated tube MC Cable may be recognized as an equipment grounding conductor if it has an ohmic resistance that is equal to or lower than the value prescribed in UL 1569. If the metallic sheath of smooth or corrugated tube MC Cable does not meet the ohmic resistance requirements, a supplemental grounding conductor sized to meet the ohmic resistance requirements, in conjunction with the metallic sheath, may be placed within the conductor assembly longitudinally, encased under the overall covering, and electrically parallel with the metallic sheath. This sheath and the supplemental grounding conductor compose the metallic sheath assembly.

UL 1569 does not currently recognize either interlocked metal tape armor alone or the metallic sheath assembly of interlocked metal tape armor MC Cable as an equipment grounding conductor. However, NEC 250-118 does recognize metal armor (the metallic sheath) alone or in combination with a grounding conductor (the metallic sheath assembly) as an equipment grounding conductor. Therefore, no change in the NEC is needed to recognize this new construction of type MC Cable.

The construction of type MC Cable has provided enhanced safety features and expanded use of metal-clad cable over that of AC Cable. Addition of the overall covering over the conductor bundle and elimination of the longitudinally laid bonding strip in MC Cable greatly reduced the possibility of damage to the conductors or conductor insulation which is present in AC Cable.

Furthermore, MC Cable has improved grounding performance over AC Cable due to construction requirements of MC Cable provided by UL 1569, Section 6.1, which requires inclusion of one of the following: (1) in cables having interlocked metal strip armor, a grounding conductor which is sized to meet the ohmic resistance values for grounding conductors provided in Table 6.1 or Table 6.2, (2) a smooth or corrugated metal sheath which meets ohmic resistance requirements provided in Table 6.1 or Table 6.2, or (3) a smooth or corrugated metal sheath and a supplemental grounding conductor sized as required to meet ohmic resistance requirements provided in Table 6.1 or Table 6.2 and electrically in parallel with the metal sheath.

Applicant is aware of no prior art where a Metal Clad Cable contains a bare bonding/grounding conductor which is cabled in concert with the conductor assembly externally over the overall cover of the conductor assembly.

SUMMARY OF THE INVENTION

The present invention relates to a Metal-Clad Cable which has an interlocked metal tape armor and a metallic sheath assembly with a low impedance and a reliable ground path which functions as an equipment grounding conductor. In the preferred embodiment, a conductor assembly contains at least two electrically insulated conductors, where the at least two electrically insulated conductors are cabled together into a bundle by twisting the conductors longitudinally together and then enclosed longitudinally within a preferably nonmetallic, overall cover. A preferably full size, bare bonding/grounding conductor is cabled externally over the overall cover of the conductor assembly with the same lay and in concert with the conductors cabled within the conductor assembly. The bare bonding/grounding conductor, which is positioned on the outside of the overall cover and within the trough created by at least two conductors cabled within the conductor assembly, is in direct contact with the inner curves of the convolutions in the interlocked metal tape armor along a substantial length of the cable. The armor and the bare bonding/grounding conductor are electrically in parallel and act in concert to provide a metallic sheath assembly which has an ohmic resistance value equal to or lower than the ohmic resistance requirements necessary to qualify as an equipment grounding conductor. Furthermore, one or more electrically insulated grounding conductors may be added within the conductor assembly to provide redundant grounding paths.

The NEC sets forth special grounding requirements for conductors to be used in patient care areas of Health Care Facilities. NEC Section 517-13 requires dual, redundant ground paths for wiring used in patient care areas of Health Care Facilities, which requirements include (1) a ground path which must be a electrically insulated grounding conductor sized in accordance with Table 250-122, and (2) a ground path which may be a metal armor or sheath or metallic sheath assembly of a cable that is recognized by the NEC as an equipment grounding conductor. There is currently no construction of MC Cable with an interlocked metal tape armor recognized and permitted for use in patient care areas of Health Care Facilities, because no such construction has an armor or a metallic sheath assembly recognized as an equipment grounding conductor. The new interlocked metal tape MC Cable construction which is the subject of this invention has a metallic sheath assembly which functions as an equipment grounding conductor. One embodiment of the present invention contains at least one electrically insulated preferably full size grounding conductor included within the conductor assembly. This embodiment meets the NEC's special grounding requirements for conductors to be used in patient care areas of Health Care Facilities. Revision of UL 1569, based upon the instant invention, is being pursued.

In AC cable, the bonding strip, which runs electrically parallel with and lengthwise along the armor, crosses the electrically insulated conductors throughout the cable at every twist. This construction creates the possibilities of damage to and failure of the conductor insulation caused by the angle of contact with the bonding strip, resulting in dielectric failure. It is an advantage of the present invention that cabling of the preferably full size bonding/grounding conductor outside the overall cover in concert with the lay of the conductors within the conductor assembly, rather than laying the bonding/grounding conductor lengthwise along the inside of the armor and across the twisted conductors, significantly reduces the potential for conductor insulation damage and dielectric failure because the bonding/grounding conductor does not cross electrically insulated conductors.

It is an object of the present invention to overcome the shortcomings of the prior art devices described above.

It is a further object of the present invention to provide a construction of interlocked metal tape MC Cable which provides grounding performance equal to the current constructions of MC Cable while reducing the material costs and weight of the cable.

It is a further object of the present invention to provide a construction of interlocked MC Cable where the metallic sheath assembly has an ohmic resistance equal to or lower than the ohmic resistance requirements necessary to qualify as an equipment grounding conductor.

It is a further object of the present invention to provide a construction of interlocked metal tape MC Cable where the metallic sheath assembly works in conjunction with an additional grounding conductor to provide dual, redundant ground paths which satisfy the NEC's grounding requirements for use in patient care areas of Health Care Facilities, in addition to other applications.

More particularly, the preferred embodiment of the present invention comprises an interlocked Metal-Clad Cable, having: a conductor assembly having at least two electrically insulated conductors, where the at least two electrically insulated conductors are cabled together into a bundle by twisting the conductors longitudinally together and where the cabled bundle of at least two electrically insulated conductors is enclosed within a preferably nonmetallic, overall cover; one preferably full size bare bonding/grounding conductor, where the preferably full size bare bonding/grounding conductor is cabled externally over the overall cover of the conductor assembly with the same lay and in concert with the at least two electrically insulated conductors cabled within the conductor assembly, and where the preferably full size bare bonding/grounding conductor is positioned within a trough created by the at least two conductors cabled within the conductor assembly; and, a roughly tube shaped covering, where the covering is an interlocking metal tape helically applied around the conductor assembly and the bare bonding/grounding conductor to form an armor covering, and where the armor covering is in engagement with and electrically parallel to the bare bonding/grounding conductor. Additionally, at least one electrically insulated grounding conductor may be cabled together with the at least two conductors within the conductor assembly.

BRIEF DESCRIPTION OF THE DRAWINGS

A better understanding of the present invention will be had upon reference to the following description in conjunction with the accompanying drawings, wherein.

DETAILED DESCRIPTION OF THE PREFERRED EMBODIMENT

Figure 1:
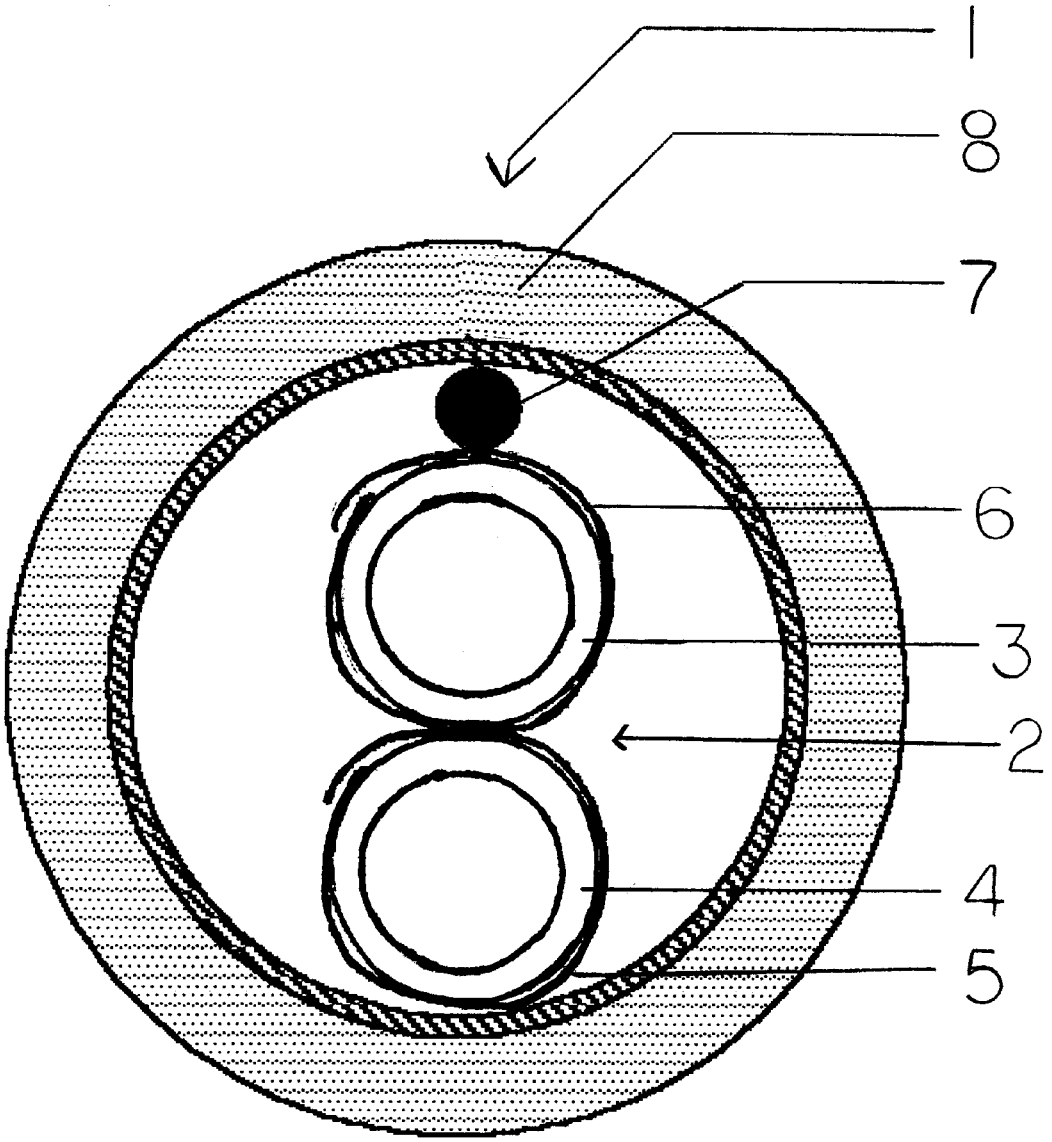
FIGURE 1 (PRIOR ART)
FIG. 1 is a cross-sectional view of prior art type AC Cable showing a conductor assembly comprising two electrically insulated conductors individually enclosed in fibrous covers; a bonding strip; and an interlocked metal tape armor encasing the conductor assembly and bonding strip.

With reference to the figures, FIG. 1 shows an example of prior art type AC Cable 1 with a conductor assembly 2 composed of two electrically insulated conductors 3, 4 individually enclosed in fibrous covers 5, 6. The two electrically insulated conductors 3, 4 in the conductor assembly 2 are cabled by twisting the conductors longitudinally together with a left-handed lay. A bare bonding strip 7 lays lengthwise along the conductor assembly 2 and electrically parallel and in contact with the interlocked metal tape armor 8, which encloses the conductor assembly 2 and bonding strip 7.

Figure 2:
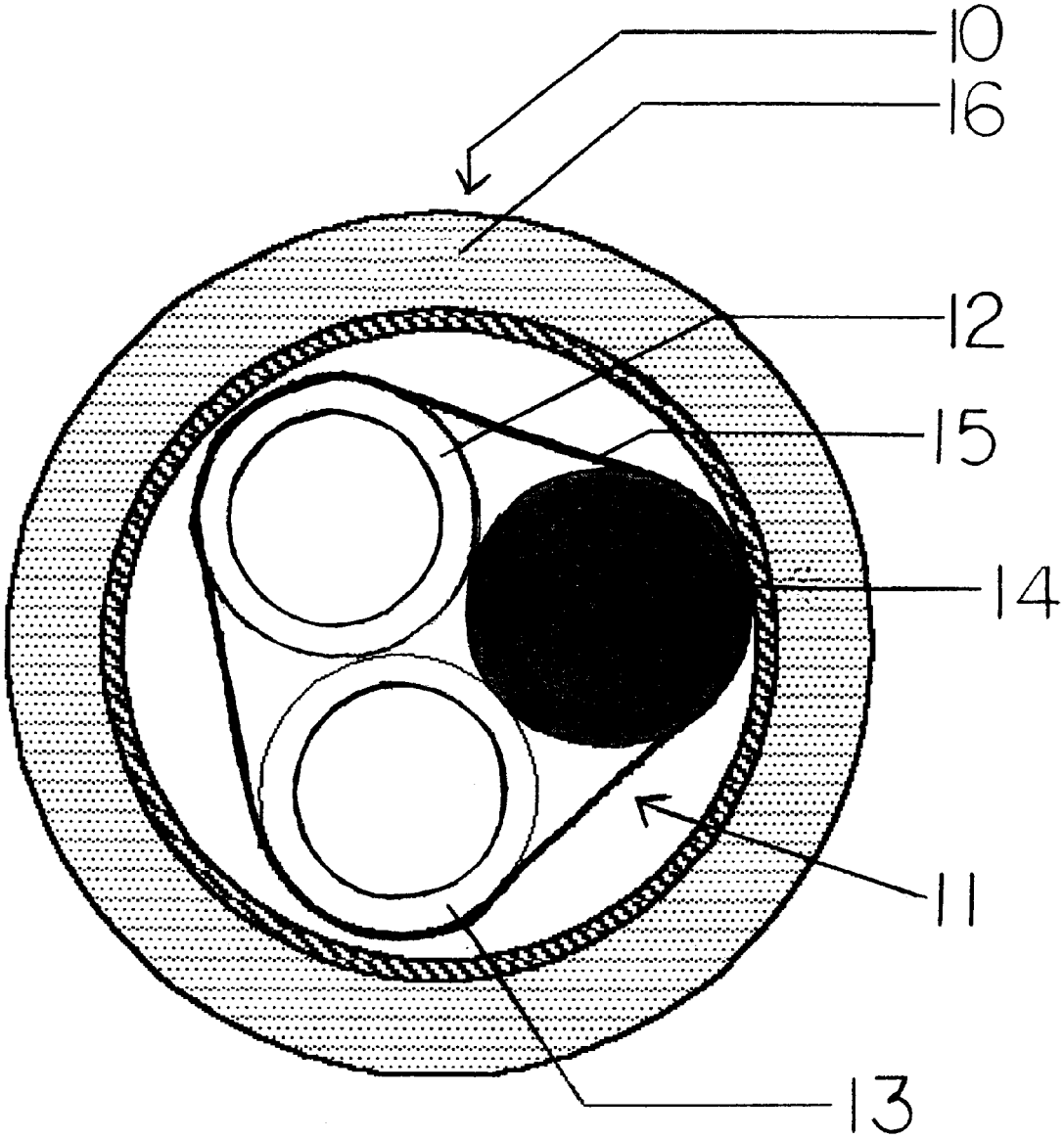
FIGURE 2 (PRIOR ART)
FIG. 2 is a cross-sectional view of prior art type MC Cable showing a conductor assembly comprising two electrically insulated conductors, an electrically insulated grounding conductor, and an overall cover collectively enclosing the conductors; and an interlocked metal tape armor encasing the conductor assembly.

FIG. 2 shows an example of prior art type MC Cable 10 with a conductor assembly 11 composed of two electrically insulated circuit conductors 12, 13 and an electrically insulated grounding conductor 14 encased in an overall covering 15. The conductors 12, 13, 14 are cabled by twisting the conductors longitudinally together with a left- or right-handed lay. Interlocked metal tape armor 16 encloses the conductor assembly 11.

Figure 3:
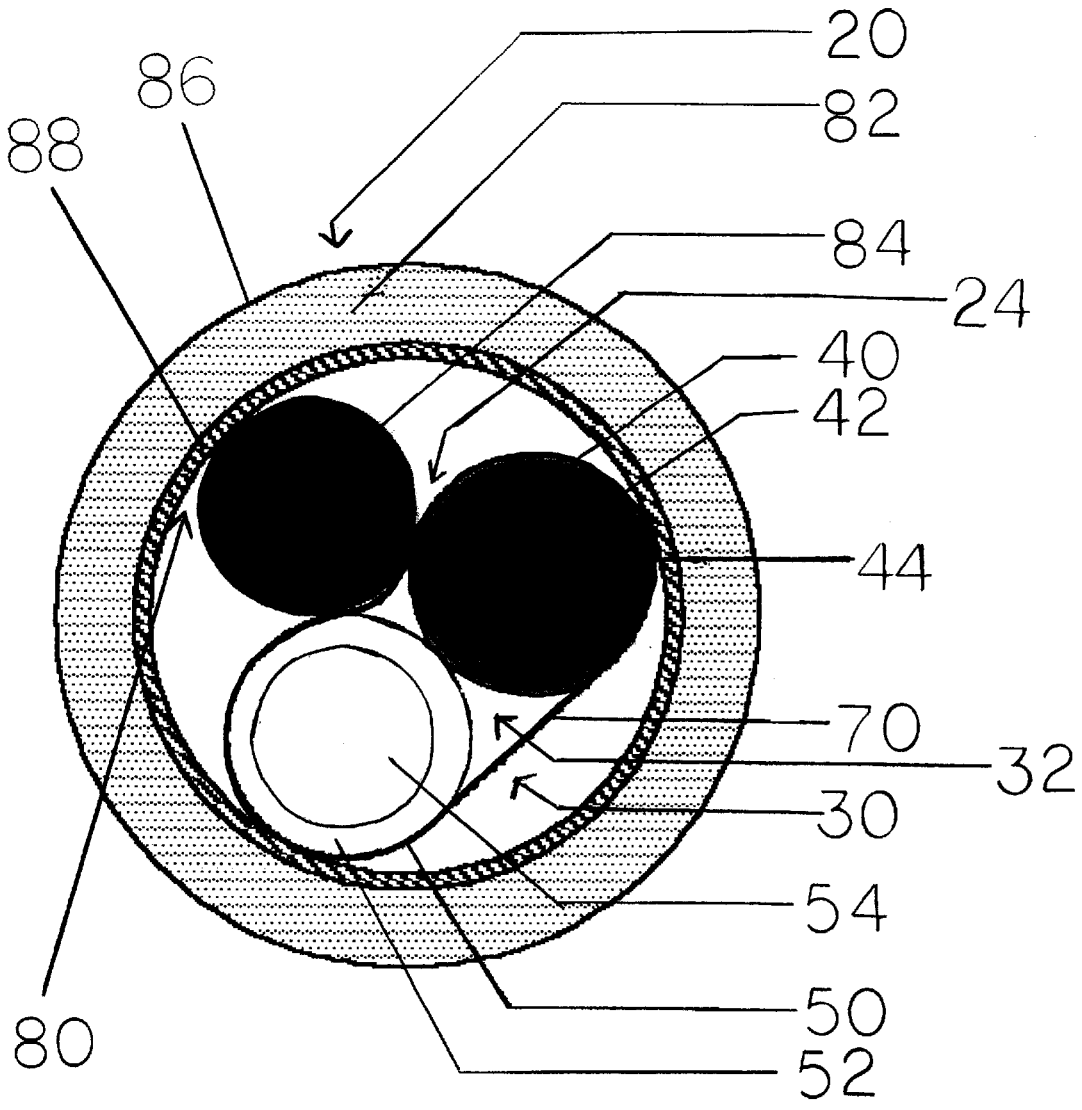
FIG. 3 is a cross-sectional view of the preferred embodiment of the present invention of type MC Cable showing a conductor assembly composed of two electrically insulated conductors with a preferably nonmetallic, overall cover collectively enclosing the electrically insulated conductors; a preferably full size bare bonding/grounding conductor cabled in concert with the conductor assembly; and an interlocked metal tape armor, which encases the conductor assembly and the preferably full size bare bonding/grounding conductor and is in contact with the preferably full size bare bonding/grounding conductor.
Figure 4:
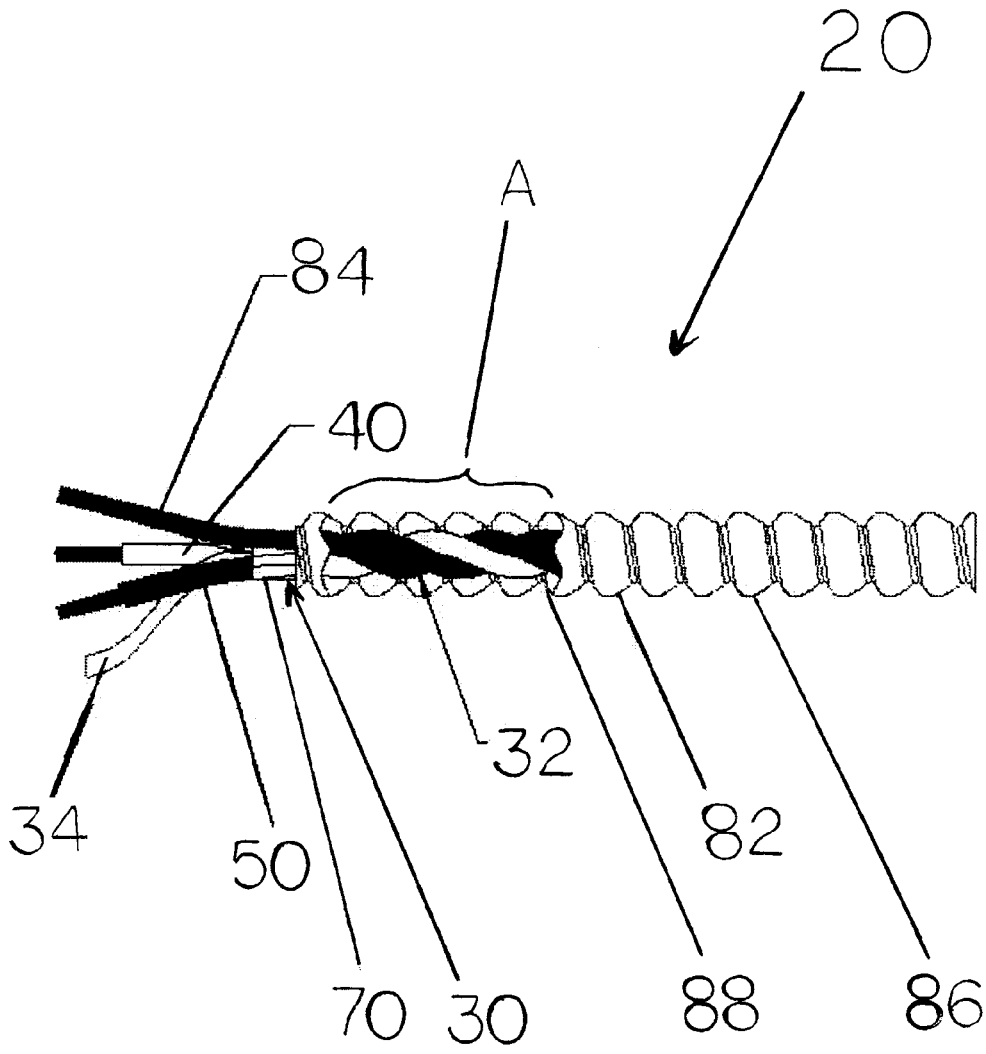
FIG. 4 is a fragmentary side elevational view of a modified form of the cable disclosed in FIG. 3, where the conductor assembly contains an identification tape.

FIGS. 3–4 show a cable 20 of the preferred embodiment having a conductor assembly 30, a preferably full size bare bonding/grounding conductor 84, and an interlocked metal tape armor 82. The conductor assembly 30 contains two electrically insulated conductors 40, 50 laying lengthwise along each other inside an overall cover 70. The overall cover 70 of the conductor assembly is preferably nonmetallic and preferably composed of polyester (Mylar) or polypropylene, but may be composed of any of a variety of materials as allowed in UL 1569. The conductor assembly may contain additional electrically insulated conductors as required. The electrically insulated conductors 40, 50 are cabled together in a longitudinally twisted bundle 32 and collectively enclosed in the overall cover 70. To cable the conductors 40, 50, each conductor 40, 50 is individually fed through a separate positioning hole in a lay plate. The conductors 40, 50 are then pulled together through an orifice into a bundle 32. The ends of the conductors 40, 50 are attached to a reel affixed to an arm within the cabling machine. The reel and arm each rotate, drawing the conductor bundle 32 into the cabling machine and at the same time twisting the conductors 40, 50 with a specific lay. The overall cover 70 is then applied around the conductor bundle 32 to complete the conductor assembly 30.

The conductor assembly 30 and the bare bonding/grounding conductor 84 are individually fed through a separate positioning hole in a lay plate and then pulled together through an orifice, where the bare bonding/grounding conductor 84 is positioned externally against the overall cover 70 of the conductor assembly 30 and within the trough 24 created by the conductors 40, 50 which are cabled within the conductor assembly 30. The bare bonding/grounding conductor 84 is preferably full size. Generally, the bare bonding/grounding conductor 84 is a similar size to the conductors 40, 50 present in the conductor assembly 30; however, as the gauge of the conductors 40, 50 increases, it is acceptable for the size difference between the bare bonding/grounding conductor 84 and the conductors 40, 50 to increase as provided in UL 1569 Tables 6.1 and 6.2. Fillers may then be cabled internally within the conductor assembly 30 to fill in undesirable spaces in the conductor assembly 30. The bare bonding/grounding conductor 84 is cabled externally over the conductor assembly 30 with the same lay and in concert with the cabling of the conductors 40, 50 cabled within the conductor assembly 30. While shown with circular cross section, a bare bonding/grounding conductor 84 of any shape cross section could be employed so long as it can be cabled. For example, a bare bonding/grounding conductor 84 could be used which is a flat tape or which has a rectangular or triangular shape.

Interlocked metal tape armor 82 is then applied by an armoring machine helically around the conductor assembly 30 and bare bonding/grounding conductor 84. The edges of the helically wrapped metal tape armor 82 interlock to form a series of "S" shaped convolutions 86 along the length of the cable 20. The inside perimeter of the interlocked metal tape armor 82 is sufficiently sized so that the bare bonding/grounding conductor 84 engages the inner curves 88 of the convolutions 86 in the interlocked metal tape armor 82 and is electrically in parallel with the armor 82. The conductor 40, 50, 84 sizing, along with the use of fillers where desired, enables the bare bonding/grounding conductor 84 to be in intimate contact with the inner curves 88 of the convolutions 86 in the interlocked metal tape armor 82 along a substantial length of the cable 20. The interlocked metal tape armor 82 and the bare bonding/grounding conductor 84 together comprise the metallic sheath assembly 80. The bare bonding/grounding conductor 84 also has a sufficient size to allow the metallic sheath assembly 80 to have an ohmic resistance equal to or lower than the ohmic resistance requirements necessary to qualify as an equipment grounding conductor under UL 1569.

In FIG. 4, a portion "A" of the interlocked metal tape armor 82 has been cut away to reveal the two electrically insulated conductors 40, 50 cabled together in a longitudinally twisted bundle 32. The overall cover 70 has also been removed in portion "A" to better demonstrate how the bare bonding/grounding conductor 84 is cabled with the same lay and in concert with the conductors 40, 50, within the trough 24 created by the conductors 40, 50, and engages the inner curves 88 of the convolutions 86 in the interlocked metal tape armor 82. FIG. 4 also shows an identification tape 34 included lengthwise within the conductor assembly 30, which may be printed with identifying information as required by UL 1569.

Figure 5:
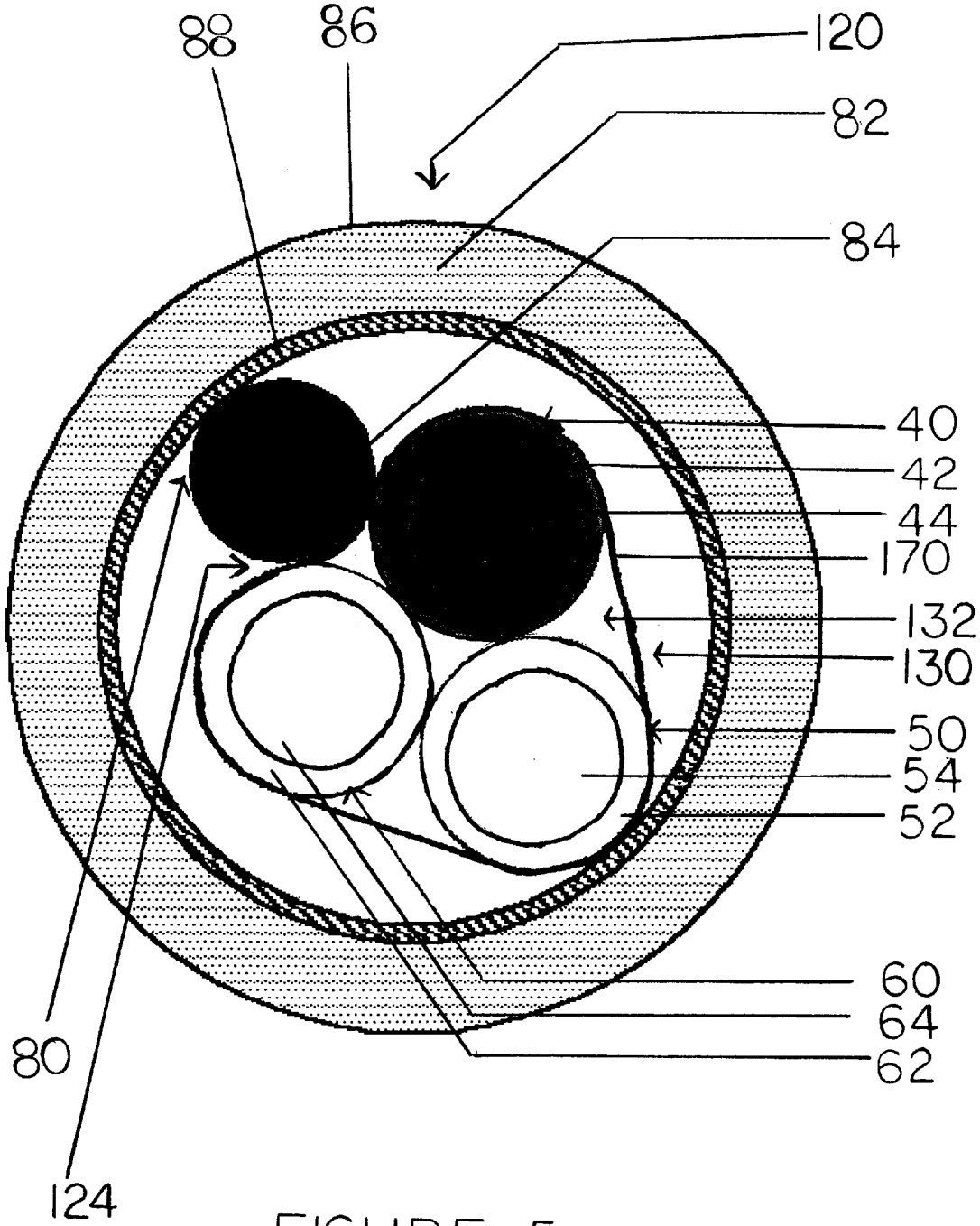
FIG. 5 is a cross-sectional view of a modified form of the cable of the present invention, where the conductor assembly contains an electrically insulated grounding conductor.

FIG. 5 shows a modified form of the present invention, where cable 120 has a conductor assembly 130, a preferably full size bare bonding/grounding conductor 84, and an interlocked metal tape armor 82. The conductor assembly 130 consists of three electrically insulated conductors 40, 50, 60 laying lengthwise along each other inside an overall cover 170. The electrically insulated conductors 40, 50, 60 are cabled together in a longitudinally twisted bundle 132 and collectively enclosed in an overall cover 170. One of the electrically insulated conductors 40, 50, 60 contained within the conductor assembly 130 is an electrically insulated grounding conductor 60. The bare bonding/grounding conductor 84 is positioned externally against the overall cover 170 of the conductor assembly 130 and within the trough 124 created by at least two of the conductors 40, 50, 60 which are cabled within the conductor assembly 130. The bare bonding/grounding conductor 84 is cabled with the conductor assembly 130 with the same lay and in concert with the cabling of the conductors 40, 50, 60 cabled within the conductor assembly 130. Interlocked metal tape armor 82 is applied helically around the conductor assembly 130 and bare bonding/grounding conductor 84. The edges of the helically wrapped metal tape armor 82 interlock to form a series of "S" shaped convolutions 86 along the length of the cable 120. The inside perimeter of the interlocked metal tape armor 82 is sufficiently sized so that the bare bonding/grounding conductor 84 engages the inner curves 88 of the convolutions 86 in the interlocked metal tape armor 82 and is electrically in parallel with the armor 82. The armor 82 and the bare bonding/grounding conductor 84 together comprise the metallic sheath assembly 80. The bare bonding/grounding conductor 84 has a sufficient size to allow the metallic sheath assembly 80 to have an ohmic resistance equal to or lower than the ohmic resistance requirements necessary to qualify as an equipment grounding conductor under UL 1569. The cable 120 has dual redundant grounding paths, namely the electrically insulated grounding conductor 60 within the conductor assembly 130 and the metallic sheath assembly 80, comprised of the interlocked metal tape 82 and the bare bonding/grounding conductor 84. The cable 120 is designed with dual redundant ground paths to meet the special equipment grounding requirements for equipment used in patient care areas of Health Care Facilities under the NEC, in addition to other applications.

In the cable 20, 120 of the present invention, the electrically insulated conductors 40, 50, 60 may be composed of conductors 44, 54, 64 made of 18 AWG—2000 kcmil copper conductor, 12 AWG—2000 kcmil aluminum conductor, or 12 AWG—2000 kcmil copper-clad aluminum conductor.

The conductors 44, 54, 64 are covered with insulation 42, 52, 62 as recommended by UL 1569. The bare bonding/grounding conductor 84 is preferably composed of aluminum. Use of aluminum in place of copper reduces the material cost and weight of the cable 20, 120. The bare bonding/grounding conductor 84 is similar in size to the conductors 40, 50, 60 contained within the conductor assembly 30, 130, which will allow the bare bonding/grounding conductor 84 to remain in intimate contact with the inner curves of the convolutions 86 in the armor 82. The overall cover 70, 170 of the conductor assembly is preferably composed of polyester (Mylar) or polypropylene, but may be composed of any of a variety of materials as allowed in UL 1569. The interlocked metal tape armor 82 is composed of steel or aluminum and preferably has a metal thickness of 0.0170 inches, although the metal thickness may be increased or reduced as appropriate.

In the cable 20, 120 of the present invention shown in FIGS. 3–5, the conductors 40, 50, 60 contained in the conductor assembly 30, 130 are cabled with a specific lay and then collectively wrapped in an overall cover 70, 170. In prior art type AC Cable 1 shown in FIG. 1, the conductors 3, 4 contained in the conductor assembly 2 are individually wrapped in fibrous covers 5, 6 and then cabled with a specific lay.

In the cable 20, 120 of the present invention shown in FIGS. 3–5, the bare bonding/grounding conductor 84 is cabled in concert with the conductor assembly 30, 130. In prior art type AC Cable 1 shown in FIG. 1, the bonding strip 7 is laid lengthwise along and is not cabled with the conductor assembly 2.

In the cable 20, 120 of the present invention shown in FIGS. 3–5, the interlocking metal tape armor 82 preferably has a metal thickness of 0.0170 inches. In prior art type AC Cable 1 shown in FIG. 1, the interlocking metal tape armor 8 preferably has a minimum metal thickness of 0.025 inches.

In the cable 20, 120 of the present invention shown in FIGS. 3–5, the conductors 40, 50, 60 may be size 18 AWG—2000 kcmil size copper conductor, 12 AWG—2000 kcmil aluminum conductor, or 12 AWG—2000 kcmil copper-clad aluminum conductor. In prior art type AC Cable 1 shown in FIG. 1, the conductors 3, 4 may be size 14 AWG—1 AWG copper conductor, 12 AWG—1 AWG aluminum conductor, or 12 AWG—1 AWG copper-clad aluminum conductor.

In the cable 20, 120 of the present invention shown in FIGS. 3–5, the bare bonding/grounding conductor 84 is not contained within the conductor assembly 30, 130. In prior art type MC Cable 10 shown in FIG. 2, the grounding conductor 14 is contained with the conductor assembly 11.

In the cable 20, 120 of the present invention shown in FIGS. 3–5, the bare bonding/grounding conductor 84 is cabled externally against the conductor assembly 30, 130 and on top of the overall cover 70, 170. In prior art type MC Cable 2 shown in FIG. 2, the grounding conductor 14 is cabled within the conductor assembly 11, beneath the overall cover 15.

In the cable 20, 120 of the present invention shown in FIGS. 3–5, the bonding/grounding conductor 84 must be bare. In prior art type MC Cable 10 shown in FIG. 2, a lone grounding conductor 14 may be electrically insulated or bare.

In the cable 20, 120 of the present invention shown in FIGS. 3–5, the bare bonding/grounding conductor 84 is positioned so that the bare bonding/grounding conductor 84 is in direct contact with the interlocked metal tape armor 82 along at least a substantial length of the armor 82. In prior art type MC Cable 10 shown in FIG. 2, no conductor 12, 13, 14 is in direct contact with the interlocked metal tape armor 16.

The foregoing detailed description is given primarily for clearness of understanding and no unnecessary limitations are to be understood therefrom, for modifications can be made by those skilled in the art upon reading this disclosure and may be made without departing from the spirit of the invention.

What is claimed is:

1. A Metal-Clad Cable, comprising:

a) a conductor assembly, having at least two conductors and a cover thereover, where said at least two conductors are cabled together in a longitudinally twisted bundle and said longitudinally twisted bundle is collectively contained within said cover;

b) a bare grounding conductor, where said bare grounding conductor is cabled with the same lay and in concert with said at least two conductors externally over said conductor assembly; and c) a metal cladding thereover.

2. The Metal-Clad Cable as recited in claim 1, where said at least two conductors are insulated.

3. The Metal-Clad Cable as recited in claim 2, where said at least two conductors are in contact with each other.

4. The Metal-Clad Cable as recited in claim 1, where said cover is composed of a nonmetallic material.

5. The Metal-Clad Cable as recited in claim 1, where said bare grounding conductor is similar in size to said at least two conductors.

6. The Metal-Clad Cable as recited in claim 1, where said metal cladding is composed of a metal tape, where the edges of said metal tape are interlocked.

7. The Metal-Clad Cable as recited in claim 6, where said metal tape is wrapped helically over said conductor assembly and said bare grounding conductor.

8. The Metal-Clad Cable as recited in claim 1, where said bare grounding conductor substantially engages said metal cladding along the length of said Metal-Clad Cable.

9. The Metal-Clad Cable as recited in claim 8, where said metal cladding and said bare grounding conductor together have an ohmic resistance value which qualifies as an equipment grounding conductor.

10. The Metal-Clad Cable as recited in claim 1, where an insulated grounding conductor is cabled with said at least two conductors internally within said conductor assembly.

11. A Metal-Clad Cable having at least two conductors and a cover thereover, where said at least two conductors are cabled together as a longitudinally twisted bundle and said at least two conductors and said cover comprise a conductor assembly, and having a metal cladding over said conductor assembly, wherein the improvement comprises:

a) said longitudinally twisted bundle collectively contained within said cover, and b) a bare grounding conductor, where said bare grounding conductor is cabled with the same lay and in concert with said at least two conductors externally over said conductor assembly and internally under said metal cladding.

12. The Metal-Clad Cable as recited in claim 11, where said at least two conductors are insulated.

13. The Metal-Clad Cable as recited in claim 12, where said at least two conductors are in contact with each other.

14. The Metal-Clad Cable as recited in claim 11, where said cover is composed of a nonmetallic material.

15. The Metal-Clad Cable as recited in claim 11, where said bare grounding conductor is similar in size to said at least two conductors.

16. The Metal-Clad Cable as recited in claim 11, where said metal cladding is composed of a metal tape, where the edges of said metal tape are interlocked.

17. The Metal-Clad Cable as recited in claim 16, where said metal tape is wrapped helically over said conductor assembly and said bare grounding conductor.

18. The Metal-Clad Cable as recited in claim 11, where said bare grounding conductor substantially engages said metal cladding along the length of said Metal-Clad Cable.

19. The Metal-Clad Cable as recited in claim 18, where said metal cladding and said bare grounding conductor together have an ohmic resistance value which qualifies as an equipment grounding conductor.

20. The Metal-Clad Cable as recited in claim 11, where an insulated grounding conductor is cabled with said at least two conductors internally within said conductor assembly.

21. A Metal-Clad Cable, comprising:

a) a conductor assembly, laving at least two conductors and a cover thereover, where said at least two conductors are cabled together in a longitudinally twisted bundle and said longitudinally twisted bundle is collectively contained within said cover;

b) a bare grounding conductor, where said bare grounding conductor is cabled externally over said conductor assembly; and c) a metal cladding thereover, where said metal cladding is composed of a metal tape, where the edges of said metal tape are interlocked.

22. The Metal-Clad Cable as recited in claim 21, where said at least two conductors are insulated.

23. The Metal-Clad Cable as recited in claim 22 where said at least two conductors are in contact with each other.

24. The Metal-Clad Cable as recited in claim 21, where said cover is composed of a nonmetallic material.

25. The Metal-Clad Cable as recited in claim 21, where said bare grounding conductor is similar in size to said at least two conductors.

26. The Metal-Clad Cable as recited in claim 21, where said metal tape is wrapped helically over said conductor assembly and said bare grounding conductor.

27. The Metal-Clad Cable as recited in claim 21 where said bare grounding conductor substantially engages said metal cladding along the length of said Metal-Clad Cable.

28. The Metal-Clad Cable as recited in claim 27 where said metal cladding and said bare grounding conductor together have an ohmic resistance value which qualifies as an equipment grounding conductor.

29. The Metal-Clad Cable as recited in claim 21, where an insulated grounding conductor is cabled with said at least two conductors internally within said conductor assembly.

30. A Metal-Clad Cable, having at least two conductors and a cover thereover, where said at least two conductors are cabled together as a longitudinally twisted bundle and said at least two conductors and said cover comprise a conductor assembly, and having a metal cladding over said conductor assembly, wherein the improvement comprises:

a) said longitudinally twisted bundle collectively contained within said cover, b) said metal cladding composed of a metal tape, where the edges of said metal tape are interlocked, and c) a bare grounding conductor, where said bare grounding conductor is cabled externally over said conductor assembly and internally under said metal cladding.

31. The Metal-Clad Cable as recited in claim 30, where said metal tape is wrapped helically over said conductor assembly and said bare grounding conductor.

* * * * *

UNITED STATES PATENT AND TRADEMARK OFFICE

CERTIFICATE OF CORRECTION

PATENT NO. : 6,486,395 B1
DATED : November 26, 2002
INVENTOR(S) : Richard M. Temblador It is certified that error appears in the above-identified patent and that said Letters Patent is hereby corrected as shown below:

Column 10,
Line 49, after “11. A Metal-Clad Cable” insert -- , --.

Column 11,
Line 21, delete “laving” and insert instead -- having --.

Signed and Sealed this

Twenty ninth Day of April, 2003

JAMES E. ROGAN
*Director of the United States Patent and Trademark Office*